United States Patent [19]

Kiesewetter et al.

[11] Patent Number: 4,918,843

[45] Date of Patent: Apr. 24, 1990

[54] GROUND ENGAGING TOOL

[75] Inventors: Martin V. Kiesewetter, Morton; William J. Renski, Peoria, both of Ill.

[73] Assignee: Caterpillar Inc., Peoria, Ill.

[21] Appl. No.: 313,278

[22] Filed: Feb. 21, 1989

[51] Int. Cl.[5] ..... E02F 9/28

[52] U.S. Cl. ..... 37/142 A; 299/92; 403/155; 403/378; 267/141

[58] Field of Search ..... 37/142 A; 403/155, 326, 403/378, 379; 299/92; 267/141, 153

[56] References Cited

U.S. PATENT DOCUMENTS

| | | | |
|---|---|---|---|
| 2,688,475 | 9/1954 | Small | 403/379 X |
| 2,913,292 | 11/1959 | Rogers | 403/156 |
| 3,128,999 | 4/1964 | Schmitt | 267/153 |
| 3,801,210 | 4/1974 | Heinold et al. | 403/318 |
| 3,863,871 | 2/1975 | Meisenheimer | 267/153 |
| 3,952,433 | 4/1976 | Heinold et al. | 37/142 A |
| 3,959,901 | 6/1976 | Klett | 37/142 R |
| 3,997,989 | 12/1976 | Stepe | 37/142 A |
| 4,096,653 | 6/1978 | Kaarlela et al. | 37/142 A |
| 4,804,290 | 2/1989 | Balsells | 403/326 |

FOREIGN PATENT DOCUMENTS

| | | | |
|---|---|---|---|
| 2015662 | 11/1970 | Fed. Rep. of Germany | 37/142 A |
| 1518824 | 7/1978 | United Kingdom . | |

*Primary Examiner*—Randolph A. Reese

*Assistant Examiner*—Arlen L. Olsen

*Attorney, Agent, or Firm*—J. W. Burrows

[57] ABSTRACT

Tip retainer mechanisms are designed primarily to secure a tip to an adapter nose for use in a variety of applications. In applications where a spring retainer is located in a recess of the adapter nose and trapped in the recess by the assembly of the tip thereon, it is necessary for the spring retainer to be properly positioned in the recess to enable easy insertion of the pin through the respective holes in the tip, adapter nose, and spring retainer. In the subject arrangement, the holder substantially encircles the outer diameter of a spring retainer. When assembled, the holder and spring retainer are placed in a recess of the adapter nose and a bore of the spring retainer is substantially axially aligned with a transverse bore of the adapter nose. Furthermore, the holder is made of an elastomeric material and has a thickness greater than a depth of the recess. Consequently, upon assembly of the tip on the adapter nose, the pin may be easily inserted through the respective holes of the tip, the transverse bore of the adapter nose, and the properly aligned bore of the spring retainer. Due to the compressive forces of the elastomeric holder, the tip is snugly held against the adapter nose to substantially eliminate the vibrations between the tip and the adapter nose.

6 Claims, 2 Drawing Sheets

GROUND ENGAGING TOOL

TECHNICAL FIELD

This invention relates generally to ground engaging tools and more specifically to a tip retainer mechanism.

BACKGROUND ART

There are many different styles of tip retainer mechanisms on the market today for the purpose of retaining tips on adapters. In many of these arrangements, the tip is assembled on the adapter, a pin extends through holes in the tip and a transverse bore in the adapter to secure the tip to the adapter. In order to keep the pin from inadvertently coming out, a retainer is normally used to retain the pin in the assembled position. This retainer mechanism has been made of various shapes and sizes. For example, U.S. Pat. No. 3,801,210 issued Apr. 2, 1974 to Lloyd K. Heinold et al. teaches a retainer mechanism that has two wire clips molded in an elastomeric material When assembled, the spring clips provide a force to retain a rectangular bar in the respective holes. Another example is illustrated in U.S. Pat. No. 3,952,433 issued Apr. 27, 1976 to Lloyd K. Heinold et al. wherein a spring clip is substantially encapsulated by a cylindrical elastomeric member. When assembled, the spring clip applies a biasing force to a pin to hold the pin in its assembled position U.S. Pat. No. 3,997,989 issued Dec. 21, 1976 to V. A. Stepe teaches an arrangement wherein two wire clip members are bonded in an elastomeric material and placed within the recess of an adapter nose. When the pin is assembled, the spring clips apply a force to the pin to retain the pin in its assembled position Additionally, U.S. Pat. No. 4,096,653 issued June 27, 1978 to W. O. Kaarlela teaches a pin retainer that has an elastomeric material secured in a metal retainer. The retainer is placed, when assembled, in a recess of the adapter nose and upon assembly of the pin, the elastomeric material applies a biasing force to the pin to secure the pin in its assembled position.

Each of the above-noted U.S. patents teach a combination in which a retainer secures a pin or bar in its assembled position for retaining a tip on the adapter. However, each of these arrangements are limited in the amount of force that can be applied to the pin for holding the pin in its assembled position. When the above-noted arrangements are operated in more harsh conditions, the pin has a tendency to move against the biasing force of the retainer and come out. Consequently, the tip falls from the adapter resulting in major damage to the adapter nose upon further use.

U.S. Pat. No. 3,959,901 issued June 1, 1976 to Gene R. Klett teaches an arrangement having a split spring retainer located in a recess of the adapter nose and a pin for holding the tip on the adapter nose. The retaining force is applied by the interference fit between the spring retainer and the pin. This mechanism provides a pin retaining system that has a larger force acting on the pin to hold it in its assembled position. However, since the diameter of the spring retainer is close to the same diameter as the recess in which it is placed, complications are created. It has been determined that during operation forces encountered on the end of the tip are being transferred through the spring retainer to the adapter nose as opposed to the forces being applied through the pin itself. Consequently, the high forces acting on the spring retainer at times causes the spring retainer to open up, thus losing its frictional force on the pin and the pin falls out. Thus allowing the tip to fall off.

In order to offset the problem of forces being transferred through the spring retainer as noted above, the outside diameter of the spring retainer has been reduced to insure that during operation there is no physical contact between the diameter of the recess and the outside diameter of the spring retainer. By changing the outside diameter of the spring retainer, the problem of forces being transferred from the tip to retainer has been eliminated. However, the reduction of the outside diameter on the spring retainer creates an additional problem. Since the outside diameter of the retainer is small with respect to the diameter of the recess, the retainer, during assembly, sets low in the recess. When insertion of the pin is attempted, the inside diameter of the retainer is not lined up with the transverse bore of the nose. Consequently, the end of the pin hits the side of the retainer and does not allow the pin to enter the retainer. In order to offset this misalignment, a large chamfer was machined on the end of the pin. The large chamfer on the pin helped alleviate a degree of misalignment but required the pin to be longer. The chamfered end of the longer pin must extend beyond the outer surface of the tip to ensure proper retention. With the pin extending beyond the end of the tip, it is subjected to foreign objects and extensive wear during operation. Many times, foreign objects cause the pin to be pushed to one side. This allows one side of the tip to be loose on the adapter since the hole in the tip is interacting only with the chamfer of the pin.

British patent specification No. 1,518,824 published on July 26, 1978 and assigned to the assignee of the subject invention teaches a system having a retainer mechanism including a pin for insertion through respective holes in the tip and adapter nose and a torsion wire spring retainer substantially ecapsulated by an elastomeric material and adapted for insertion into a counterbore of the adapter nose. During assembly, the spring retainer exerts a force on the pin to hold the pin in its proper assembled position. Furthermore, in FIG. 4 the pin has a groove therein and upon assembly, the spring retainer is positioned in the groove to aid in pin retention.

The present invention is directed to overcoming one or more of the problems as set forth above.

DISCLOSURE OF THE INVENTION

In one aspect of the present invention, a tip retainer mechanism is provided and adaptable to retain a ground engaging bit to an adapter nose. The adapter nose defines a transverse bore which extends between first and second sides thereof. The tip defines a cavity which is operative to mate with the adapter nose and has a pair of laterally spaced holes in first and second sidewalls of the tip. A recess is defined in one of the first and second sides of the adapter nose or in one of the first and second sidewalls of the tip and is in axial alignment with the respective one of the transverse bore or laterally spaced holes. The recess has a predetermined size and shape as viewed in a cross section taken perpendicular to the transverse bore. When assembled, the laterally spaced holes of the tip, the recess, and the transverse bore are in substantial axial alignment. A generally annular split spring retainer, when assembled, is disposed in the recess and defines a bore therein. A holder defines a receiving opening therein and when assembled, the spring retainer is disposed in the receiving opening of the holder. The holder has a size and shape generally equal to the size and shape of the recess and is operative upon assembly to center the spring retainer in a position substantially concentric with the transverse bore and the laterally spaced holes. A pin is provided having a diameter larger than the diameter of the bore in the retainer and is disposed when assembled in the transverse bore, the laterally spaced holes, and the spring retainer. The pin is held in place by a mechanical fit between the pin and the retainer.

In another aspect of the present invention, a tip retainer mechanism is provided and adapted to retain a ground engaging tip to an adapter nose. The adapter nose defines a transverse bore extending between first and second sides thereof. The tip defines a cavity operative to mate with the adapter nose and has a pair of laterally spaced holes in first and second sidewalls thereof. A recess is defined in one of the first and second sides of the adapter or one of the first and second sidewalls of the tip and is in axial alignment with respective one of the transverse bore or laterally spaced holes. The recess has a predetermined depth and upon assembly a generally annular split spring retainer is disposed in the recess. When assembled, the laterally spaced holes, the recess and the transverse bore are in substantial axial alignment. The spring retainer defines a bore therein. A holder defines a receiving opening therein and is operative when assembled to be disposed in the recess and encircle the spring retainer. The holder has a thickness greater than the depth of the recess and is operative upon assembly to provide a snug fit between the tip and the adapter nose to substantially eliminate vibrations of the tip on the adapter. A pin is provided having a diameter larger than the diameter of the bore in the retainer and when assembled is disposed in the transverse bore, the laterally spaced holes, and the spring retainer. The pin is held in place by the mechanical fit between the pin and the retainer.

The present invention provides a tip retainer mechanism which has a spring retainer with adequate force to hold a pin in the assembled position while not having an outside diameter that would allow any transfer of force from the tip directly to the spring retainer during operation. Furthermore, the holder locates the spring retainer during assembly so that the bore of the spring retainer is substantially in axial alignment with the laterally spaced holes of the tip an the transverse bore of the adapter nose. Furthermore, the holder is operative to substantially eliminate the loose fit between the adapter nose and the cavity of the tip so that substantially all vibrations between the tip and the adapter nose are eliminated.

BEST MODE FOR CARRYING OUT THE INVENTION

Figure 1:
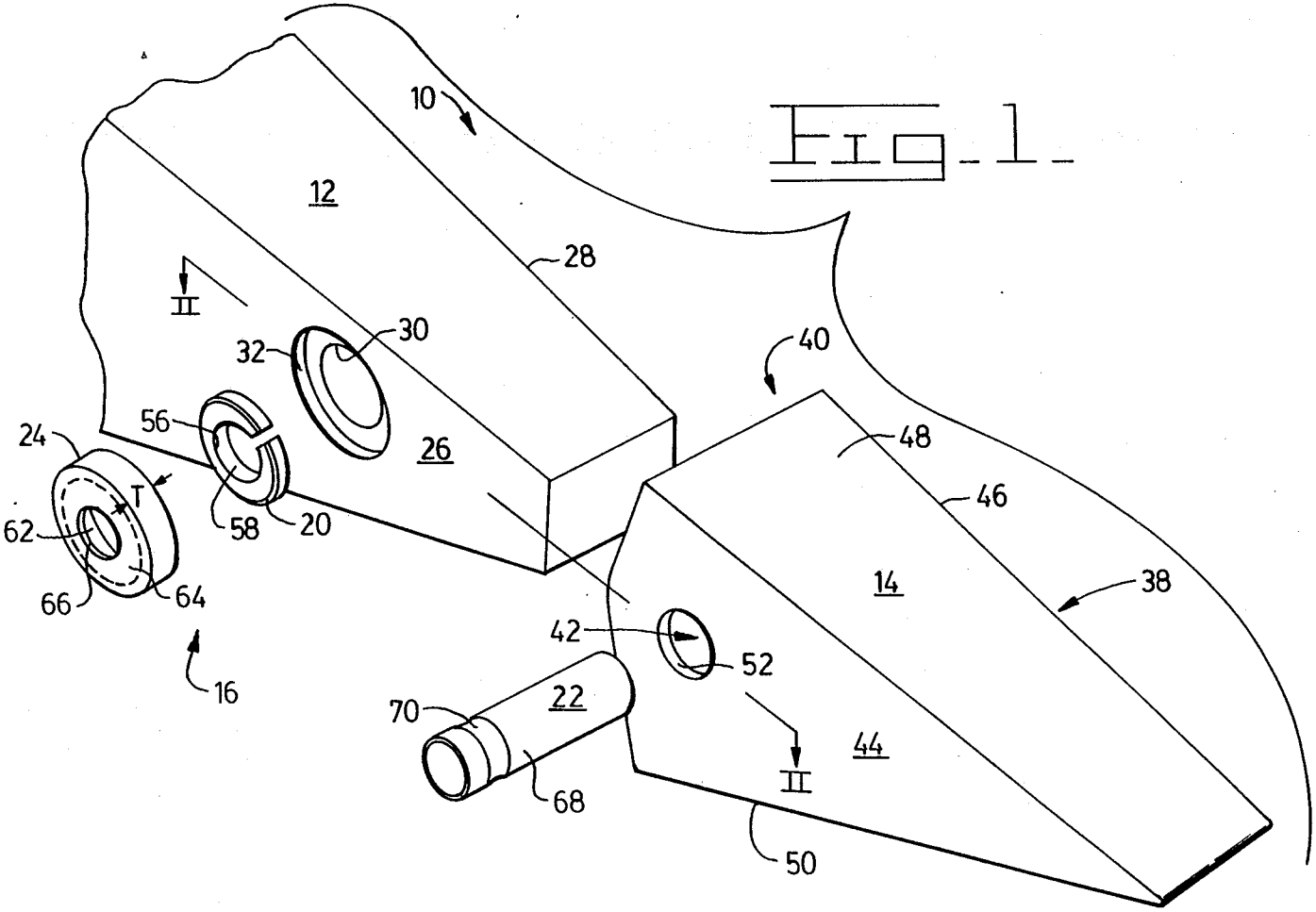
FIG. 1 is an isometric view which illustrates an embodiment of the present invention with an earthworking tip mounted on an adapter nose.

With reference to drawings, a ground engaging tool 10 is provided. The ground engaging tool 10 includes an adapter nose 12, a tip 14, and a tip retainer mechanism 16. The tip retainer mechanism 16 includes a generally annular split spring retainer 20, a pin 22, and a holder 24.

The adapter nose 12 has first and second sides 26, 28 and defines a transverse bore 30 between the first and second sides 26, 28. A recess 32 is defined in the adapter nose 26 on the first side thereof concentric with the transverse bore 30 and has a predetermined size and shape as viewed in a cross section taken perpendicular to the transverse bore 30. The recess 32 is annular in shape and has a predetermined depth "D" and a diameter of a predetermined size. It should be recognized that the recess 32 could also be located in the second side of the adapter nose without departing from the essence of the invention.

The ground engaging tip 14 has a first end portion 38 for engaging the ground and a second end portion 40 adaptable to mate with the adapter nose 12. The second end portion 40 has a cavity 42 defined by first and second sidewalls 44, 46 and top and bottom walls 48, 50, and the first end portion 38. Axially aligned laterally spaced holes 52 are defined in the first and second sidewalls 44, 46.

The spring retainer 20 has a surface 58 defining a bore 56 therein. The spring retainer 20 has an outside diameter with the maximum size being less than 90% of the diameter of the recess 32. The spring retainer 20 is located, when assembled, in the recess 32 of the adapter nose 12.

The holder 24 is made from an elastomeric material, such as Hytrel, which is a brand name of an elastomeric material manufactured by E. I. du Pont de Nemours and Company. The holder 24 defines a receiving opening 62 therein and has a side portion 64 with a bore 66 defined therein. The receiving opening 62 has a diameter substantially the same size as the outside diameter of the spring retainer 20 and the bore 66 has a diameter of a predetermined size. The holder 24 has a predetermined thickness "T" and a size and shape as viewed in a cross section taken perpendicular to the thickness thereof generally equal to the size and shape of the recess 32. Upon assembly, the holder 24 is located in the recess 32 and encircles the spring retainer 20. The side portion 64 of the holder 24 is substantially adjacent to and extends outward beyond the first side 26 of the adapter nose 12.

The pin 22 has a diameter larger than the diameter of the bore 56 of the spring retainer 20 and has an outer peripheral surface 68. A groove 70 is defined in the outer peripheral surface 68 axially spaced from one end thereof at a position to generally align with the recess 32 when the pin 22 is installed. Upon assembly, the pin 22 is located within the transverse bore 30 and the laterally spaced hole 52. Furthermore, the pin 22 is disposed through bore 56 of the the spring retainer 20 When the pin 22 is properly positioned the spring retainer 20 is located within the groove 70. A mechanical fit is provided between the surface 58 of the spring retainer 20 and the surface of the groove 70 and operative to hold the pin 22 in the assembled position. The mechanical fit may be a compressive, clamping force of the retainer 20 onto the surface of the groove 70, as shown, or the retainer 20 may be loosely fit within the groove 70. Furthermore, with the groove 70 omitted, the mechanical fit may be in the form of a frictional interference fit between the surface 58 of the retainer 20 and the peripheral surface 68 of the pin 22.

Figure 2:
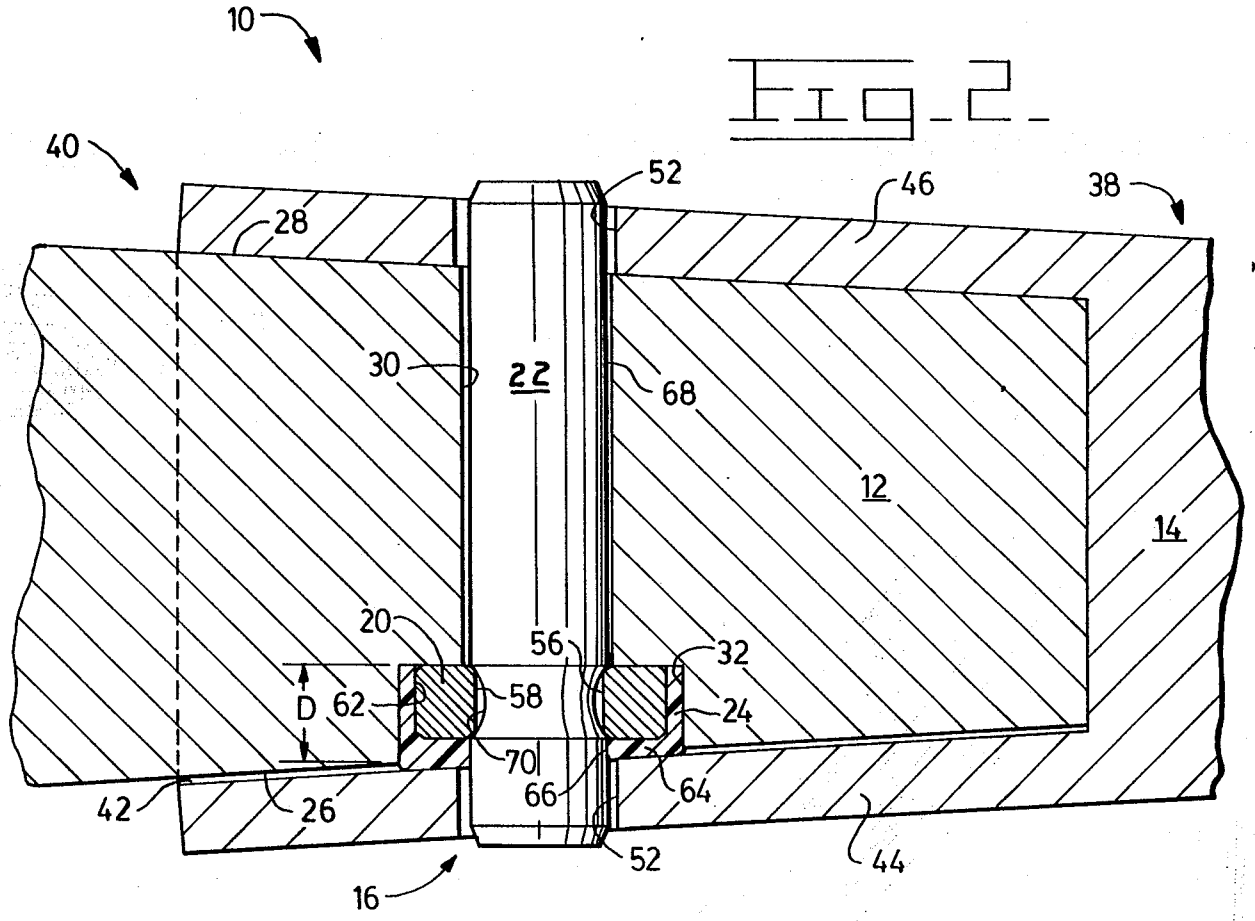
FIG. 2 is a partial cross-sectional view of the ground engaging tool taken through the latitudinal axis of the pin, the annular spring retainer, and the holder.

Even though, in the embodiment shown in FIGS. 1 and 2, the recess 32 is located in the first side 26 of the adapter nose 12, it is recognized that the recess 32 could be located in one of the first and second sidewalls 44,46 of the tip 14. It is also recognized that if the recess 32 were located in one of the first and second sidewalls 44,46, the sidewalls would have to be made thicker in order to accommodate the spring retainer 20 and the holder 24.

INDUSTRIAL APPLICABILITY

In the operation of the ground engaging tool 10, the tip retainer mechanism 16 must be able to secure the tip 14 to the adapter 12 when being exposed to many different types of operating conditions. In many operations, the tip retainer mechanism 16 is subjected to harsh forces and extremely high temperatures. This type of operating condition many times causes the retaining pin to slip from its properly assembled position. Split spring retainers are normally sufficient to retain the pin in most applications. However, during assembly, the spring retainer may be in a position which restricts insertion of the pin through the respective holes. The restriction is normally caused by the end of the pin contacting the side of the retainer and not allowing easy insertion thereof.

In the present arrangement, the spring retainer 20 is placed within the receiving opening 62 of the holder 24 and the assembly is placed within the recess 32 of the adapter nose 12. The side portion 64 of the holder 24, when assembled, is on the outside of the recess 32. Since the holder 24 has an outside diameter substantially the same as the diameter of the recess 32, the bore 56 of the retainer 20 is substantially axially aligned with the transverse bore 30 of the adapter nose 12.

Additionally, the side portion 64 of the holder 24 extends beyond the first side 26 of the adapter nose 12 since the thickness "T" of the holder 24 is greater than the depth "D" of the recess 32. Upon assembly of the tip 14 on the adapter nose 12, the inside surface of the first sidewall 44 of the tip 14 compresses the elastomeric material of the holder 24. The resistance of the elastomeric holder 24 to compression subjects the first sidewall 44 of the tip 14 to a force tending to move the first sidewall 44 away from the first side 26 of the adapter nose 12. This results in the second sidewall 46 of the tip 14 being moved into intimate contact with the second side 28 of the adapter nose 12. The continuous force being exerted by the holder 24 on the first sidewall 44 of the tip results in the tip being held in a snug relationship with respect to the adapter nose 12. This relationship substantially eliminates any vibration of the tip 14 on the adapter nose 12.

Once the tip 14 has been placed in its assembled position with respect to the adapter nose 12, the pin 22 may be easily inserted through the laterally spaced hole 52 in the second sidewall 46 of the tip 14 and the transverse bore 30 of the adapter nose 12, then pressed through the bore 56 of the properly aligned spring retainer 20, and subsequently through the hole 52 of the first sidewall 44.

In most applications, if the outside diameter of the spring retainer 20 is below 90% of the diameter of the recess 32, a holder 24 is needed to properly align the bore 56 of the spring retainer 20 within the transverse bore 30.

The tip retainer mechanism 16, as illustrated herein, provides a retainer mechanism that is generally simple in construction and easy to assemble since the holder 24 properly axially aligns the spring retainer 20 with the transverse bore 30. Furthermore, vibrations of the tip 14 on the adapter nose 12 is substantially eliminated by the separating force being applied by the elastomeric holder 24 between the adapter nose 12 and the first side wall 44 of the tip 14.

Other aspects, objects, and advantages of this invention can be obtained from a study of the drawings, the disclosure, and the appended claim.

We claim:

1. A ground engaging tool having an adapter nose, a ground engaging tip mounted on the adapter nose, and a tip retainer mechanism for retaining the tip on the adapter nose, said adapter nose defining a transverse bore extending between first and second sides thereof, said tip defining a cavity operative to mate with the adapter nose and a pair of laterally spaced holes in first and second sidewalls thereof, and a recess defined in one of the first and second sides of the adapter nose or one of the first and second sidewalls of the tip and in axial alignment with the respective one of the transverse bore or the laterally spaced holes, the recess has a predetermined depth, when assembled the laterally spaced holes, the recess, and the transverse bore are in substantial axial alignment, the ground engaging tool comprising:

a generally annular split spring retainer disposed in the recess, said spring retainer defining a bore therein;

a holder defining a receiving opening therein, said holder being disposed in the recess and encircles the spring retainer, the holder having an axial thickness greater than the depth of the recess and being operative to provide a snug fit between the tip and adapter nose to substantially eliminate excessive vibrations of the tip on the adapter; and a pin having a diameter larger than the diameter of the bore in the retainer, said pin being disposed in the transverse bore, the laterally spaced holes, and the spring retainer, said pin being held in place by a mechanical fit between the pin and the spring retainer.

2. The ground engaging tool, as set forth in claim 1, wherein the recess has a predetermined size and shape as viewed in a cross section taken perpendicular to the transverse bore and the holder has a size and shape generally equal to the size and shape of the recess, said holder being operative to substantially axially align the spring retainer with the transverse bore and the laterally spaced holes.

3. The ground engaging tool, as set forth in claim 2, wherein the holder has a side portion defining a bore therein, said bore of the side portion having a diameter substantially equal to the diameter of the pin.

4. The ground engaging tool, as set forth in claim 3, wherein the recess is located in the adapter nose and is annular in shape.

5. The ground engaging tool, as set forth in claim 4, wherein the holder is made from an elastomeric material.

6. The ground engaging tool, as set forth in claim 5, wherein the diameter of the recess is of a predetermined size and the maximum diameter of the spring retainer is generally below 90 percent of the diameter of the recess.

* * * * *